United States Patent [19]

Brock

[11] 4,361,329

[45] Nov. 30, 1982

[54] PUTTING CLUB INCLUDING BALL PICK UP DEVICE

[76] Inventor: James A. Brock, 2166 West Blvd., Cleveland, Ohio 44102

[21] Appl. No.: 196,738

[22] Filed: Oct. 14, 1980

[51] Int. Cl.[3] ..... A63B 53/04

[52] U.S. Cl. ..... 273/162 E; 273/80 C; 273/171

[58] Field of Search ..... 273/77 R, 80 C, 80.2, 273/80.7, 164, 167–175, 162 E

[56] References Cited

U.S. PATENT DOCUMENTS

| | | | |
|---|---|---|---|
| D. 257,050 | 9/1980 | Cicero | 273/167 G X |
| 1,436,579 | 11/1922 | Dayton | 273/168 X |
| 1,518,316 | 12/1924 | Ellingham | 273/171 |
| 3,397,888 | 8/1968 | Springer et al. | 273/80.7 X |
| 3,549,300 | 12/1970 | Pelz | 273/164 X |
| 3,944,231 | 3/1976 | Johnson | 273/162 E |

OTHER PUBLICATIONS

"Golf Digest", Aug. 1967, p. 72.

*Primary Examiner*—George J. Marlo
*Attorney, Agent, or Firm*—Watts, Hoffmann, Fisher & Heinke Co.

[57] ABSTRACT

A putter device for use in the playing in the game of golf including an elongated shaft member having a hand gripping portion at one end and a head member for putting a golf ball at the other end. The head member being connected to the shaft at a point which is disposed forward of the center of gravity and the geometric center of the head member whereby the golf ball can be putted with improved accuracy and consistency. The toe end of the putter head may be provided with a scoop-like receptacle adapted for picking up a golf ball. The heel end portion of the head may include therein a removable weight.

2 Claims, 5 Drawing Figures

PUTTING CLUB INCLUDING BALL PICK UP DEVICE

TECHNICAL FIELD

The present invention relates to putter devices and more particularly relates to an improved construction and design for a golf putter utilized in the playing of the game of golf. It will be understood, moreover, that the putter device of the invention can be utilized in playing all types of games where putting a golf ball or the like is involved, such as in miniature golf or the like.

Heretofore, over the many years that the game of golf has been played and enjoyed, there have been designs developed for many various type of putter devices to enable the player to strike the golf ball with greater accuracy and consistency for putting under various playing conditions. For example, it has been known to provide conventional type putter devices where the bottom portion of the putter shaft is attached to the putter head substantially at the inner or "heel" end of the putter. In other forms, the shaft has been attached slightly forward of the "heel" end or even at the geometric center of the putter head in the form of a "croquet" style putter. It has been found, however, that such prior devices are not completely satisfactory for accurate and consistent putting, particularly with respect to putting at relatively long lengths, such as in excess of 15 feet.

DISCLOSURE OF THE INVENTION

A new and novel putting device for use in playing the game of golf comprising an elongated shaft having a hand-gripping portion fixedly connected to a putter head member. The putter head member includes a generally polygonal, such as rectangular, configuration in top plane view defined by generally planar side and end walls, a generally planar top surface and an arcuate bottom surface. The putter shaft is fixedly attached at an acute angle to the putter head member and is disposed forwardly of the center of gravity and of geometric center thereof. Preferably, the shaft is fixedly connected inwardly of the forward most portion or toe end of the putter head member. The opposite or heel end portion of the putter head may be selectively weighted by detachable counter-weight means, as desired. The toe end portion of the putter head may be provided with a scoop-like receptacle adapted for picking up and/or lifting a golf ball, as desired.

By foregoing arrangement when taken in conjunction with the following description and accompanying drawings, it can be seen that the present invention provides a new and novel putter device for playing the game of golf which applicant has found to provide improved accuracy and consistency in increasing one's putting skills and techniques in relation to putts of any length, particularly those in excess of 15 feet, for example. Specifically, in the present invention it has been found that the putter device enables one to maintain that which is commonly referred to as the square-to-square stance in relation to the pendulum or up-right swing for striking the golf ball in relation to the desired arc for swinging the golf club. This swing relation is dependent on one's size and stature. For example, it has been found that the fixedly off-set connection between the shaft and putter head has the tendency to automatically center the club head whether it be taken back on the "inside" or on the "outside" during the take-away portion of the normal swing. In other words, this construction and arrangement, as found by the applicant, tends to reduce excessive swinging either from the "inside" or the "outside" so as to reduce, if not, prevent, "pulling" or "pushing" the put. Accordingly, by this construction and arrangement the off-set disposition of the club head in relation to the center of gravity and geometric center thereof tends to draw the club head back into the player's normal swing-pattern so as to maintain the face of the putter at right angles to the golf ball or in this square-to-square relationship for striking the ball in the designated "sweet spot" of the putter head. Further, by this construction and arrangement this tendency of the putter device to automatically provide self-centering, enables the player to strike the golf ball in the area of the "sweet-spot". This allows the player to strike the ball with increased firmness thereby enabling the player to putt with greater accuracy and at relatively greater lengths without having to take an excessive back-swing. In addition, the present invention contemplates the ability to selectively provide a predetermined counter-weight to the putter head adjacent to the heel portion to provide the optimum dynamic balance characteristics for the desired putting conditions.

BEST MODE FOR CARRYING OUT THE INVENTION

Figure 1:
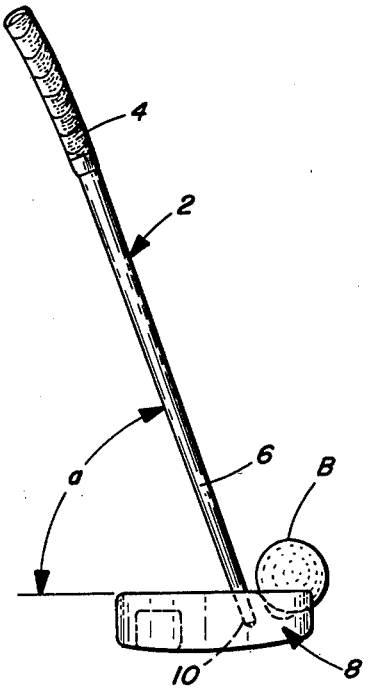
FIG. 1 is a general side elevation view illustrating the putter device made in accordance with the present invention.
Figure 2:
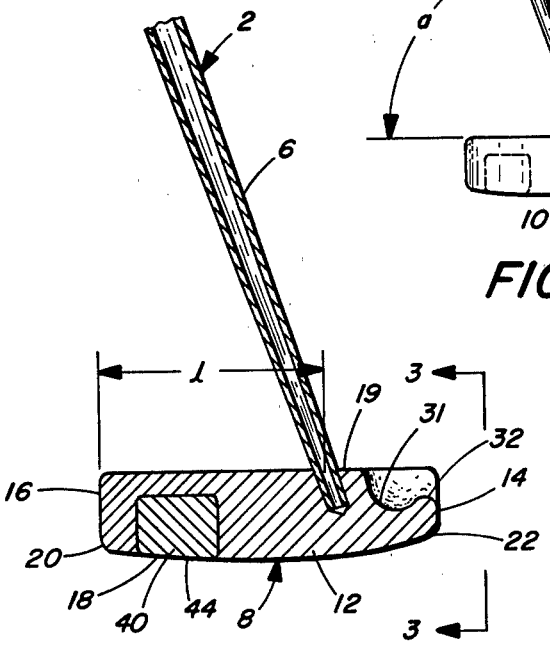
FIG. 2 is a fragmentary, generally vertical section view, on an enlarged scale, illustrating the putter device of the present invention.
Figure 3:
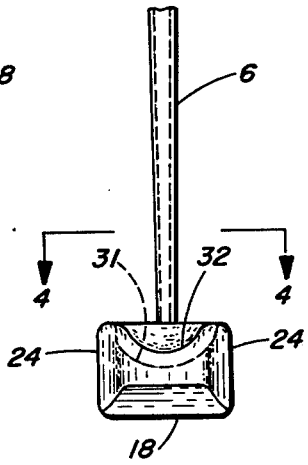
FIG. 3 is a fragmentary, front elevation view of the putter device illustrated in FIG. 1.

Referring again to the drawings and in particular to FIG. 1 thereof, there is illustrated the golf putter, designated generally at 2, made in accordance with the present invention. The golf putter device 2, in the above illustrated, generally includes an elongated shaft 6 with a hand-grip end-portion 4. The shaft 6 is fixedly attached to a head member 8 by means of a threaded connection, as at 10. Preferably, the shaft 6 is disposed at an acute angle (a) of approximately 70 degrees in relation to the general plane of the head member 8. The golf putter device is constructed and arranged for putting and/or receiving a conventional golf ball, designated generally at B.

In the invention, it is critical that the shaft 6 be disposed forwardly of the center of gravity of the geometric center of the head member 8. For example, with a head member 8 having a length of 4 inches the critical distance L is preferably 2 7/16 inches. Accordingly, the shaft 6 is disposed in a forwardly off-set relation with respect to the center of gravity and the geometric center of the head member and at an acute angle with respect thereto.

Figure 4:
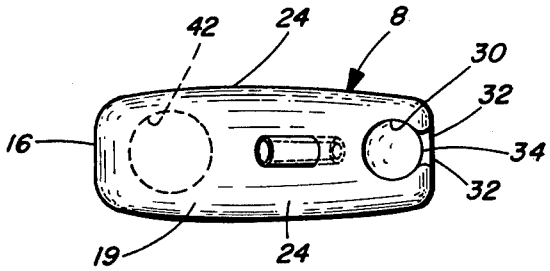
FIG. 4 is a fragmentary, top plane view of the putter device illustrated in FIG. 2.

Now in the invention, the head member 8 includes an elongated body 12 having oppositely disposed ends 14 and 16. The body 12 has a generally planar top surface 19 and a slightly curved lower surface 18. The end surfaces 14 and 16 are rounded, as at 20 and 22, to provide a smooth putting surface. The body 12 has a pair of oppositely disposed generally arcuate side surfaces 24 which, together with the end surfaces 14 and 16, provide a generally rectangular configuration, as best illustrated in FIG. 4.

Figure 5:
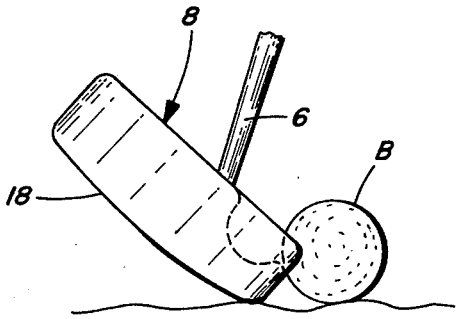
FIG. 5 is a generally side elevation view schematically illustrating the putter device of the present invention for use in scooping-up a golf ball.

In the invention, the forward end of the putter head 8 includes a generally circular recess portion 30 which has a curved bottom as at 31, adapted for receiving and holding the golf ball B therein. The recess 30 communicates with the front surface 14 via an opening 34 which terminates in a fore-shortened rounded edge 32 that provides an abuttment for retaining the golf ball B while enabling the ball to be scooped-up so as to be held in the recess 30, as illustrated in FIG. 5. Accordingly, by this arrangement there is provided a novel structural arrangement which allows the player to scoop or pick up the golf ball without necessarily having to bend over to retreive the same thereby providing an aid to the player.

In the invention, the rear portion of the putter head member 8 may be provided with a removable counter-weight member, designated generally at 40. The counter-weight member may have a curved lower surface, as at 44, to correspond with the bottom contour of the bottom surface 18. The counter-weight member 40 may be disposed for removal within a circular recess, as at 42, to provide optimum swing characteristics for the putter.

I claim:

1. A golf putter device comprising an elongated head member and an elongated shaft member secured at one end to said head member, said shaft being disposed at an acute angle with respect to the general plane of said head member and being off-set forwardly of the center of gravity and forward of the geometric center of said head member, said head member including a recessed portion disposed adjacent its forward most end adapted for scooping up a golf ball, the rearward most end of said head member having a removable counter-weight means disposed therein, and said recessed portion providing a void area to dynamically balance the head member in relation to the counter-weight means so that said shaft is located forward of the "sweet spot" of the head member.

2. A putter device in accordance with claim 1, wherein said counter-weight means is selectively adjustable to provide in cooperation with said recessed portion a dynamic balance characteristic in the putter for accurate striking of said "sweet spot" with said golf ball.

* * * * *